US008939608B1

(12) United States Patent
Patrick

(10) Patent No.: US 8,939,608 B1
(45) Date of Patent: Jan. 27, 2015

(54) HEAT MANAGEMENT FOR A LIGHT FIXTURE WITH AN ADJUSTABLE OPTICAL DISTRIBUTION

(75) Inventor: Ellis W. Patrick, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 186 days.

(21) Appl. No.: 13/600,790

(22) Filed: Aug. 31, 2012

Related U.S. Application Data

(63) Continuation of application No. 12/961,315, filed on Dec. 6, 2010, now Pat. No. 8,256,923, which is a continuation of application No. 12/183,490, filed on Jul. 31, 2008, now Pat. No. 7,874,700.

(60) Provisional application No. 60/994,371, filed on Sep. 19, 2007.

(51) Int. Cl.
*F21S 4/00* (2006.01)

(52) U.S. Cl.
USPC ..... 362/249.02; 362/231

(58) Field of Classification Search
USPC ..... 362/249.02, 545, 226, 231, 247, 800
See application file for complete search history.

(56) References Cited

U.S. PATENT DOCUMENTS

| | | | | |
|---|---|---|---|---|
| 1,447,238 | A | 3/1923 | Crownfield | |
| 1,711,478 | A | 4/1929 | Cromwell | |
| 4,271,408 | A | 6/1981 | Teshima et al. | |
| 5,673,997 | A | 10/1997 | Akiyama | |
| 5,826,970 | A | 10/1998 | Keller et al. | |
| 6,343,871 | B1 | 2/2002 | Yu | |
| 6,448,900 | B1 | 9/2002 | Chen | |
| 6,561,690 | B2 | 5/2003 | Balestriero et al. | |
| 6,578,983 | B2 | 6/2003 | Holten | |
| 6,682,211 | B2 | 1/2004 | English et al. | |
| 7,048,412 | B2 | 5/2006 | Martin et al. | |
| 7,242,028 | B2 | 7/2007 | Dry | |
| 7,568,817 | B2 | 8/2009 | Lee et al. | |
| 7,874,700 | B2 | 1/2011 | Patrick | |
| 8,100,556 | B2 | 1/2012 | Patrick | |
| 2004/0037088 | A1* | 2/2004 | English et al. | 362/545 |
| 2005/0030753 | A1 | 2/2005 | Tickner et al. | |
| 2005/0174780 | A1 | 8/2005 | Park | |
| 2008/0316755 | A1 | 12/2008 | Zheng et al. | |
| 2009/0040759 | A1 | 2/2009 | Zhang et al. | |
| 2009/0073688 | A1 | 3/2009 | Patrick et al. | |
| 2009/0073689 | A1 | 3/2009 | Patrick | |
| 2009/0244896 | A1 | 10/2009 | McGehee et al. | |
| 2009/0262530 | A1 | 10/2009 | Tickner et al. | |

* cited by examiner

*Primary Examiner* — Anne Hines
(74) *Attorney, Agent, or Firm* — King & Spalding LLP

(57) ABSTRACT

A light fixture includes a member having a substantially frusto-conical shape. A channel extends between a wide top end of the member and a narrower bottom end of the member. The member includes multiple surfaces ("facets") disposed around its outer surface. Each facet is configured to receive one or more light emitting diodes ("LEDs") in a linear or non-linear array. Each facet can be integral to the member or coupled to the member. The channel is configured to transfer heat generated by the LEDs through convection. Fins can be disposed within the channel, extending from the inner surface of the member to an inner channel. The fins are configured to transfer heat away from, and provide a greater surface area for convecting heat away from, the member. For example, one or both of the channels can transfer heat by a venturi effect.

18 Claims, 5 Drawing Sheets

HEAT MANAGEMENT FOR A LIGHT FIXTURE WITH AN ADJUSTABLE OPTICAL DISTRIBUTION

RELATED APPLICATIONS

This patent application is a continuation of U.S. patent application Ser. No. 12/961,315 filed on Dec. 6, 2010, which is a continuation of and claims priority under 35 U.S.C. §120 to U.S. patent application Ser. No. 12/183,490 filed on Jul. 31, 2008, which claims priority under 35 U.S.C. §119 to U.S. Provisional Patent Application No. 60/994,371, titled "Flexible Light Emitting Diode Optical Distribution," filed Sep. 19, 2007. In addition, this patent application is related to U.S. patent application Ser. No. 12/183,499 titled "Light Fixture With An Adjustable Optical Distribution," filed Jul. 31, 2008. The complete disclosure of each of the foregoing priority and related applications is hereby fully incorporated by reference herein.

TECHNICAL FIELD

The invention relates generally to light fixtures and more particularly to light fixtures with adjustable optical distributions.

BACKGROUND

A luminaire is a system for producing, controlling, and/or distributing light for illumination. For example, a luminaire includes a system that outputs or distributes light into an environment, thereby allowing certain items in that environment to be visible. Luminaires are used in indoor or outdoor applications.

A typical luminaire includes one or more light emitting elements, one or more sockets, connectors, or surfaces configured to position and connect the light emitting elements to a power supply, an optical device configured to distribute light from the light emitting elements, and mechanical components for supporting or suspending the luminaire. Luminaires are sometimes referred to as "lighting fixtures" or as "light fixtures." A light fixture that has a socket, connector, or surface configured to receive a light emitting element, but no light emitting element installed therein, is still considered a luminaire. That is, a light fixture lacking some provision for full operability may still fit the definition of a luminaire. The term "light emitting element" is used herein to refer to any device configured to emit light, such as a lamp or a light-emitting diode ("LED").

Optical devices are configured to direct light energy emitted by light emitting elements into one or more desired areas. For example, optical devices may direct light energy through reflection, diffusion, baffling, refraction, or transmission through a lens. Lamp placement within the light fixture also plays a significant role in determining light distribution. For example, a horizontal lamp orientation typically produces asymmetric light distribution patterns, and a vertical lamp orientation typically produces a symmetric light distribution pattern.

Different lighting applications require different optical distributions. For example, a lighting application in a large, open environment may require a symmetric, square distribution that produces a wide, symmetrical pattern of uniform light. Another lighting application in a smaller or narrower environment may require a non-square distribution that produces a focused pattern of light. For example, the amount and direction of light required from a light fixture used on a street pole depends on the location of the pole and the intended environment to be illuminated.

Traditional light fixtures are configured to only output light in a single, predetermined distribution. To change an optical distribution in a given environment, a person must uninstall an existing light fixture and install a new light fixture with a different optical configuration. These steps are cumbersome, time consuming, and expensive.

Therefore, a need exists in the art for an improved means for adjusting optical distribution of a light fixture. In particular, a need exists in the art for efficient, user-friendly, and cost-effective systems and methods for adjusting light emitting diode optical distribution of a light fixture.

SUMMARY

The invention provides an improved means for adjusting optical distribution of a light fixture. In particular, the invention provides a light fixture with an adjustable optical distribution. The light fixture can be used in indoor and/or outdoor applications.

The light fixture includes a member having multiple surfaces disposed at least partially around a channel extending through the member. The member can have any shape, whether polar or non-polar, symmetrical or asymmetrical. For example, the member can have a frusto-conical or cylindrical shape.

Each surface is configured to receive at least one LED. For example, each surface can receive one or more LEDs in a linear or non-linear array. Each surface can be integral to the member or coupled thereto. For example, the surfaces can be formed on the member via molding, casting, extrusion, or die-based material processing. Alternatively, the surfaces can be mounted or attached to the member by solder, braze, welds, glue, plug-and-socket connections, epoxy, rivets, clamps, fasteners, or other fastening means.

Each LED can be removably coupled to a respective one of the surfaces. For example, each LED can be mounted to its respective surface via a substrate that includes one or more sheets of ceramic, metal, laminate, or another material. The optical distribution of the light fixture can be adjusted by changing the output direction and/or intensity of one or more of the LEDs. In other words, the optical distribution of the light fixture can be adjusted by mounting additional LEDs to certain surfaces, removing LEDs from certain surfaces, and/or by changing the position and/or configuration of one or more of the LEDs across the surfaces or along particular surfaces. For example, one or more of the LEDs can be repositioned along a different surface, repositioned in a different location along the same surface, removed from the member, or reconfigured to have a different level of electric power to adjust the optical distribution of the light fixture. A given light fixture can be adjusted to have any number of optical distributions. Thus, the light fixture provides flexibility in establishing and adjusting optical distribution.

As a byproduct of converting electricity into light, LEDs generate a substantial amount of heat. The member can be configured to manage heat output by the LEDs. Specifically, the channel extending through the member is configured to transfer the heat output from the LEDs by convection. Heat from the LEDs is transferred to the surfaces by conduction and to the channel, which convects the heat away. For example, the channel can transfer heat by the venturi effect.

The shape of the channel can correspond to the shape of the member. For example, if the member has a frusto-conical shape, the channel can have a wide top end and a narrower bottom end. Alternatively, the shape of the channel can be independent of the shape of the member.

Fins can be disposed within the channel to assist with the heat transfer. For example, the fins can extend from the surfaces into the channel, towards a core region of the member. The core region can include a point where the fins converge. In addition, or in the alternative, the core region can include a member disposed within and extending along the channel and having a shape defining a second, inner channel that extends through the member. The fins can be configured to transfer heat by conduction from the facets to the inner channel. Like the outer channel, the inner channel can be configured to transfer at least a portion of that heat through convection. This air movement assists in dissipating heat generated by the LEDs.

These and other aspects, features and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the present invention and the advantages thereof, reference is now made to the following description, in conjunction with the accompanying figures briefly described as follows.

DETAILED DESCRIPTION OF EXEMPLARY EMBODIMENTS

The present invention is directed to systems for adjusting optical distribution of a light fixture. In particular, the invention provides efficient, user-friendly, and cost-effective systems for adjusting optical distribution of a light fixture. The term "optical distribution" is used herein to refer to the spatial or geographic dispersion of light within an environment, including a relative intensity of the light within one or more regions of the environment.

Figure 1:
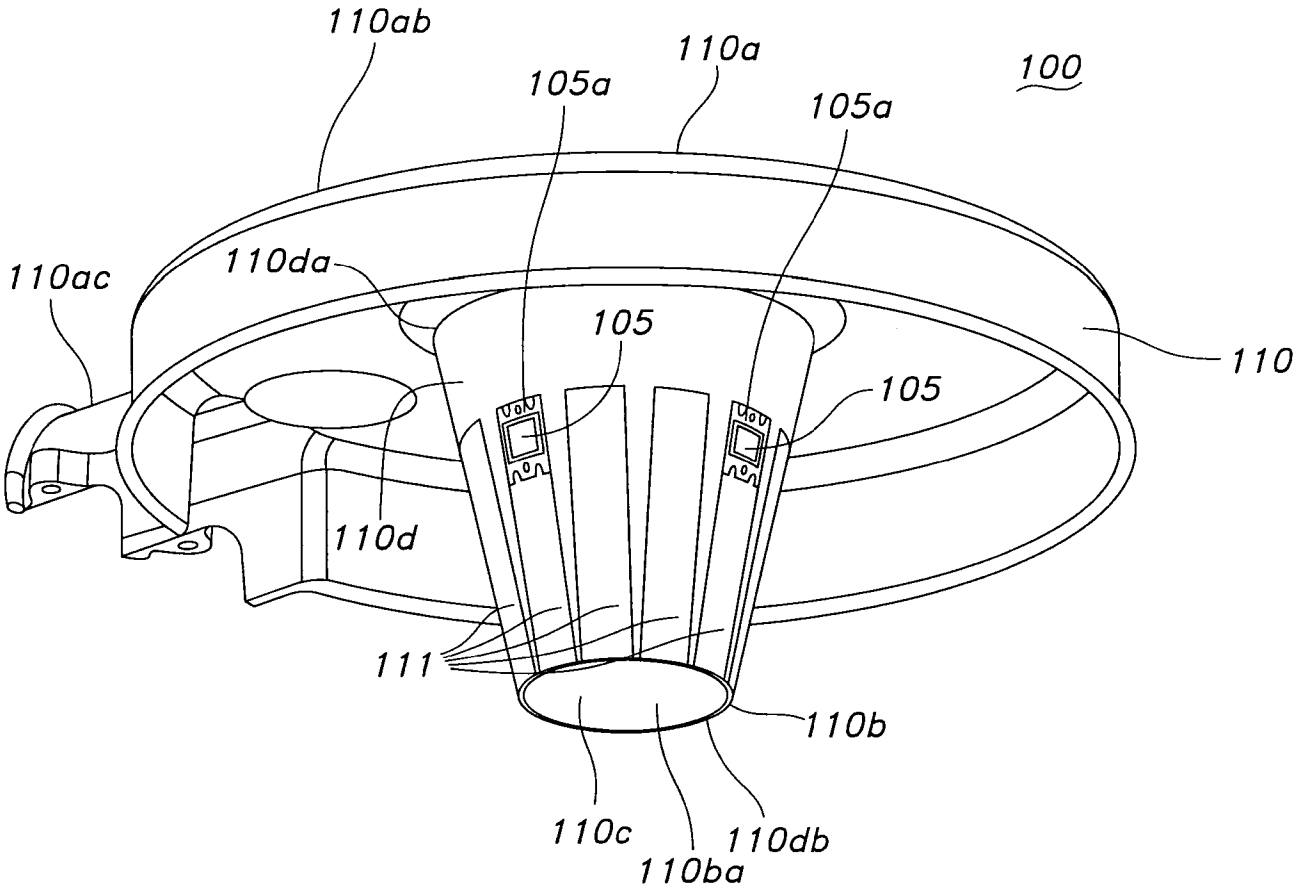
FIG. 1 is a perspective view of a light fixture with an optical distribution capable of being adjusted, according to certain exemplary embodiments.
Figure 2:
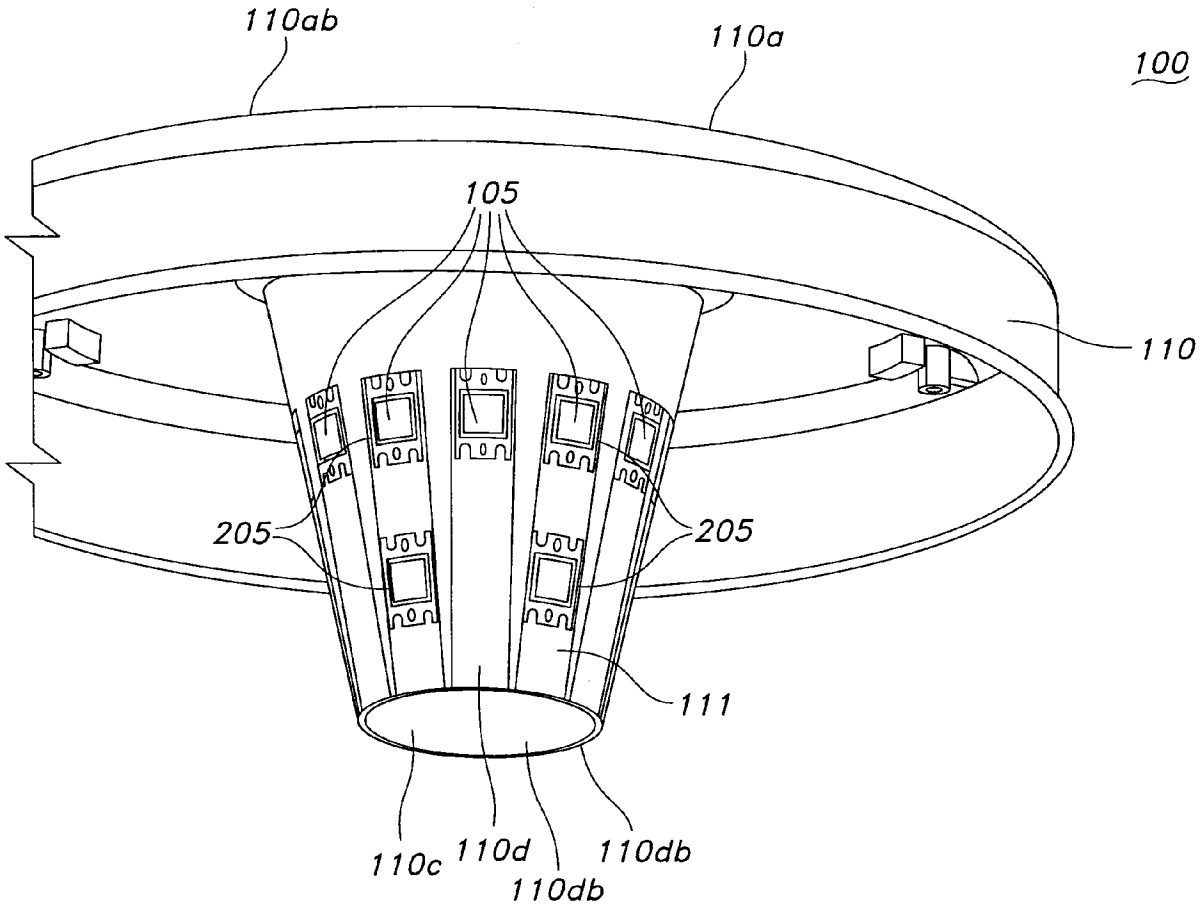
FIG. 2 is another perspective view of the exemplary light fixture of FIG. 1, wherein the light fixture has a different optical distribution than that illustrated in FIG. 1.

Turning now to the drawings, in which like numerals indicate like elements throughout the figures, exemplary embodiments of the invention are described in detail. FIG. 1 is a perspective view of a light fixture 100 with an optical distribution capable of being adjusted, according to certain exemplary embodiments. FIG. 2 is another perspective view of the light fixture 100, wherein the light fixture 100 has a different optical distribution than that illustrated in FIG. 1. With reference to FIGS. 1 and 2, the light fixture 100 is an electrical device configured to create artificial light or illumination in an indoor and/or outdoor environment. For example, the light fixture 100 is suited for mounting to a pole (not shown) or similar structure, for use as a street light.

In the exemplary embodiments depicted in FIGS. 1 and 2, the light fixture 100 is configured to create artificial light or illumination via one or more LEDs 105. Each LED 105 is mounted to an outer surface 111 of a housing 110. The housing 110 includes a top end 110*a* and a bottom end 110*b*. Each end 110*a* and 110*b* includes an aperture 110*aa* (FIG. 4) and 110*ba*, respectively. A channel 110*c* extends through the housing 110 and connects the apertures 110*aa* and 110*ba*. The top end 110*a* includes a substantially round top surface 110*ab* disposed around the channel 110*c*. A mounting member 111*ac* extends outward from the top surface 110*ab*, in a direction away from the channel 110*c*. The mounting member 110*ac* is configured to be coupled to the pole, for mounting the light fixture 100 thereto.

In certain exemplary embodiments, a light-sensitive photocell 310 is coupled to the mounting member 110*ac*. The photocell 310 is configured to change electrical resistance in a circuit that includes one or more of the LEDs 105, based on incident light intensity. For example, the photocell 310 can cause the LEDs 105 to output light at dusk but not to output light at dawn.

A member 110*d* extends downward from the top surface 110*ab*, around the channel 110*c*. The member 110*d* has a frusto-conical geometry, with a top end 110*da* and a bottom end 110*db* that has a diameter that is less than a diameter of the top end 110*da*. Each outer surface 111 includes a substantially flat, curved, angular, textured, recessed, protruding, bulbous, and/or other-shaped surface disposed along an outer perimeter of the member 110*d*. For simplicity, each outer surface 111 is referred to herein as a "facet." The LEDs 105 can be mounted to the facets 111 by solder, braze, welds, glue, plug-and-socket connections, epoxy, rivets, clamps, fasteners, or other means known to a person of ordinary skill in the art having the benefit of the present disclosure.

In the exemplary embodiments depicted in FIGS. 1 and 2, the housing 110 includes twenty facets 111. The number of facets 111 can vary depending on the size of the LEDs 105, the size of the housing 110, cost considerations, and other financial, operational, and/or environmental factors known to a person of ordinary skill in the art having the benefit of the present disclosure. As will be readily apparent to a person of ordinary skill in the art, a larger number of facets 111 corresponds to a higher level of flexibility in adjusting the optical distribution of the light fixture 100. In particular, as described below, each facet 111 is configured to receive one or more LEDs 105 in one or more positions. The greater the number of facets 111 present on the member 110*d*, the greater the number of LED 105 positions, and thus optical distributions, available.

In the embodiments depicted in FIGS. 1 and 2, the end 110*a* and member 110*d* are integral to the housing 110, and the facets 111 are integral to the member 110*d*. In certain exemplary embodiments, the housing 110 and/or the end 110*a*, member 110*d*, and/or facets 111 thereof can be formed via molding, casting, extrusion, or die-based material processing. For example, the housing 110 and facets 111 can be comprised of die-cast aluminum. In certain alternative exemplary embodiments, the end 110*a*, member 110*d*, and/or facets 111 include separate components coupled together to form the housing 110. For example, the facets 111 can be mounted or attached to the member 110*d* by solder, braze, welds, glue, plug-and-socket connections, epoxy, rivets, clamps, fasteners, or other attachment means known to a person of ordinary skill in the art having the benefit of the present disclosure.

Each facet 111 is configured to receive a column of one or more LEDs 105. The term "column" is used herein to refer to an arrangement or a configuration whereby one or more LEDs 105 are disposed approximately in or along a line. LEDs 105 in a column are not necessarily in perfect alignment with one another. For example, one or more LEDs 105 in a column might be slightly out of perfect alignment due to manufacturing tolerances or assembly deviations. In addition, LEDs 105 in a column might be purposely staggered in a non-linear arrangement. Each column extends along an axis of its associated facet 111.

In certain exemplary embodiments, each LED 105 is mounted to its corresponding facet 111 via a substrate 105*a*. Each substrate 105*a* includes one or more sheets of ceramic, metal, laminate, or another material. Each LED 105 is attached to its respective substrate 105*a* by a solder joint, a plug, an epoxy or bonding line, or another suitable provision for mounting an electrical/optical device on a surface. Each substrate 105*a* is connected to support circuitry (not shown) or a driver (not shown) for supplying electrical power and control to the associated LED 105. The support circuitry (not shown) includes one or more transistors, operational amplifiers, resistors, controllers, digital logic elements, or the like for controlling and powering the LED 105.

In certain exemplary embodiments, the LEDs 105 include semiconductor diodes configured to emit incoherent light when electrically biased in a forward direction of a p-n junction. For example, each LED 105 can emit blue or ultraviolet light. The emitted light can excite a phosphor that in turn emits red-shifted light. The LEDs 105 and the phosphors can collectively emit blue and red-shifted light that essentially matches blackbody radiation. The emitted light approximates or emulates incandescent light to a human observer. In certain exemplary embodiments, the LEDs 105 and their associated phosphors emit substantially white light that may seem slightly blue, green, red, yellow, orange, or some other color or tint. Exemplary embodiments of the LEDs 105 can include indium gallium nitride ("InGaN") or gallium nitride ("GaN") for emitting blue light.

In certain exemplary embodiments, one or more of the LEDs 105 includes multiple LED elements (not shown) mounted together on a single substrate 105*a*. Each of the LED elements can produce the same or a distinct color of light. The LED elements can collectively produce substantially white light or light emulating a blackbody radiator. In certain exemplary embodiments, some of the LEDs 105 produce one color of light while others produce another color of light. Thus, in certain exemplary embodiments, the LEDs 105 provide a spatial gradient of colors.

In certain exemplary embodiments, optically transparent or clear material (not shown) encapsulates each LED 105 and/or LED element, either individually or collectively. This material provides environmental protection while transmitting light. For example, this material can include a conformal coating, a silicone gel, cured/curable polymer, adhesive, or some other material known to a person of ordinary skill in the art having the benefit of the present disclosure. In certain exemplary embodiments, phosphors configured to convert blue light to light of another color are coated onto or dispersed in the encapsulating material.

Figure 3:
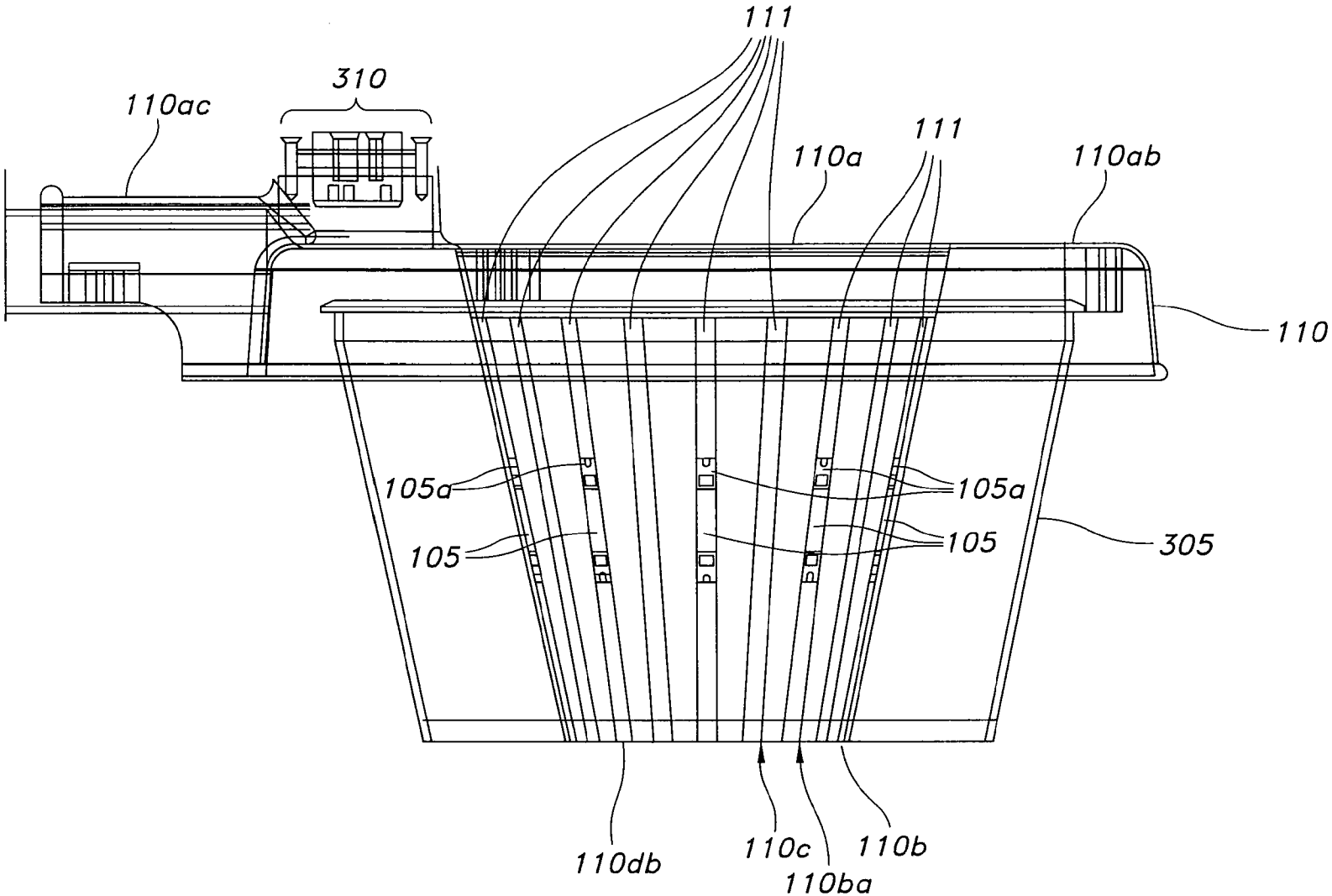
FIG. 3 is a side elevational view of a light fixture with an optical distribution capable of being adjusted, according to certain alternative exemplary embodiments.

The optical distribution of the light fixture 100 depends on the positioning and configuration of the LEDs 105 within the facets 111. For example, as illustrated in FIG. 1 and FIG. 3, described below, positioning multiple LEDs 105 symmetrically along the outer perimeter of the member 110*d*, in a polar array, can create a type V symmetric distribution of light. Outdoor area and roadway luminaires are designed to distribute light over different areas, classified with designations I, II, III, IV, and V. Generally, type II distributions are wide, asymmetric light patterns used to light narrow roadways (i.e. 2 lanes) from the edge of the roadway. Type III asymmetric distributions are not quite as wide as type II distributions but throw light further forward for wider roadways (i.e. 3 lanes). Similarly, a type IV asymmetric distribution is not as wide as the type III distribution but distributes light further forward for wider roadways (4 lanes) or perimeters of parking lots. A type V distribution produces a symmetric light pattern directly below the luminaire, typically either a round or square pattern of light. For example, positioning LEDs 105 only in three adjacent facets 111 can create a type IV asymmetric distribution of light.

As illustrated in FIG. 2, positioning multiple LEDs 105 in the same facet 111 increases directional intensity of the light relative to the facet 111 (as compared to a facet 111 with only one or no LEDs 105). For example, positioning the LEDs 105 in a linear array 205 along the facet 111 increases directional intensity of the light substantially normal to the axis of the facet 111. Directional intensity also can be adjusted by increasing or decreasing the electric power to one or more of the LEDs 105. For example, overdriving one or more LEDs 105 increases the directional intensity of the light from the LEDs 105 in a direction normal to the corresponding facet 111. Similarly, using LEDs 105 with different sizes and/or wattages can adjust directional intensity. For example, replacing an LED 105 with another LED 105 that has a higher wattage can increase the directional intensity of the light from the LEDs 105 in a direction normal to the corresponding facet 111.

The optical distribution of the light fixture 100 can be adjusted by changing the output direction and/or intensity of one or more of the LEDs 105. In other words, the optical distribution of the light fixture 100 can be adjusted by mounting additional LEDs 105 to the member 110*d*, removing LEDs 105 from the member 110*d*, and/or by changing the position and/or configuration of one or more of the LEDs 105. For example, one or more of the LEDs 105 can be repositioned in a different facet 111, repositioned in a different location within the same facet 111, removed from the light fixture 100, or reconfigured to have a different level of electric power. A given light fixture 100 can be adjusted to have any number of optical distributions.

For example, if a particular lighting application only requires light to be emitted towards one direction, LEDs 105 can be placed only on facets 111 corresponding to that direction. If the intensity of the emitted light in that direction is too low, the electric power to the LEDs 105 may be increased, and/or additional LEDs 105 may be added to those facets 111. Similarly, if the intensity of the emitted light in that direction is too high, the electric power to the LEDs 105 may be decreased, and/or one or more of the LEDs 105 may be removed from the facets 111. If the lighting application changes to require a larger beam spread of light in multiple directions, additional LEDs 105 can be placed on empty, adjacent facets 111. In addition, the beam spread may be tightened by moving one or more of the LEDs 105 downward within their respective facets 111, towards the bottom end 110*db*. Similarly, the beam spread may be broadened by moving one or more of the LEDs 105 upwards within their respective facets 111, towards the top end 110*da*. Thus, the light fixture 100 provides flexibility in establishing and adjusting optical distribution.

Although illustrated in FIGS. 1 and 2 as having a frustoconical geometry, a person of ordinary skill in the art having the benefit of the present disclosure will recognize that the member 110*d* can have any shape, whether polar or non-polar, symmetrical or asymmetrical. For example, the member 110*d* can have a cylindrical shape. Similarly, although illustrated as having a substantially vertical orientation, each facet 111 may have any orientation, including, but not limited to, a horizontal or angular orientation, in certain alternative exemplary embodiments.

The level of light a typical LED 105 outputs depends, in part, upon the amount of electrical current supplied to the LED 105 and upon the operating temperature of the LED 105. Thus, the intensity of light emitted by an LED 105 changes when electrical current is constant and the LED's 105 temperature varies or when electrical current varies and temperature remains constant, with all other things being equal. Operating temperature also impacts the usable lifetime of most LEDs 105.

As a byproduct of converting electricity into light, LEDs 105 generate a substantial amount of heat that raises the operating temperature of the LEDs 105 if allowed to accumulate on the LEDs 105, resulting in efficiency degradation and premature failure. The member 110*d* is configured to manage heat output by the LEDs 105. Specifically, the frusto-conical shape of the member 110*d* creates a venturi effect, drawing air through the channel 110*c*. The air travels from the bottom end 110*db* of the member 110*d*, through the channel 110*c*, and out the top end 110*da*. This air movement assists in dissipating heat generated by the LEDs 105. Specifically, the air dissipates the heat away from the member 110*d* and the LEDs 105 thereon. Thus, the member 110*d* acts as a heat sink for the LEDs 105 positioned within or along the facets 111.

FIG. 3 is a side elevational view of a light fixture 300 with an optical distribution capable of being adjusted. The light fixture 300 is identical to the light fixture 100 of FIGS. 1 and 2 except that the light fixture 300 includes a cover 305. The cover 305 is an optically transmissive element that provides protection from dirt, dust, moisture, and the like. The cover 305 is disposed at least partially around the facets 111, with a top end thereof being coupled to the top surface 110*ab* of the housing 110. In certain exemplary embodiments, the cover 305 is configured to control light from the LEDs 105 via refraction, diffusion, or the like. For example, the cover 305 can include a refractor, a lens, an optic, or a milky plastic or glass element.

Figure 4:
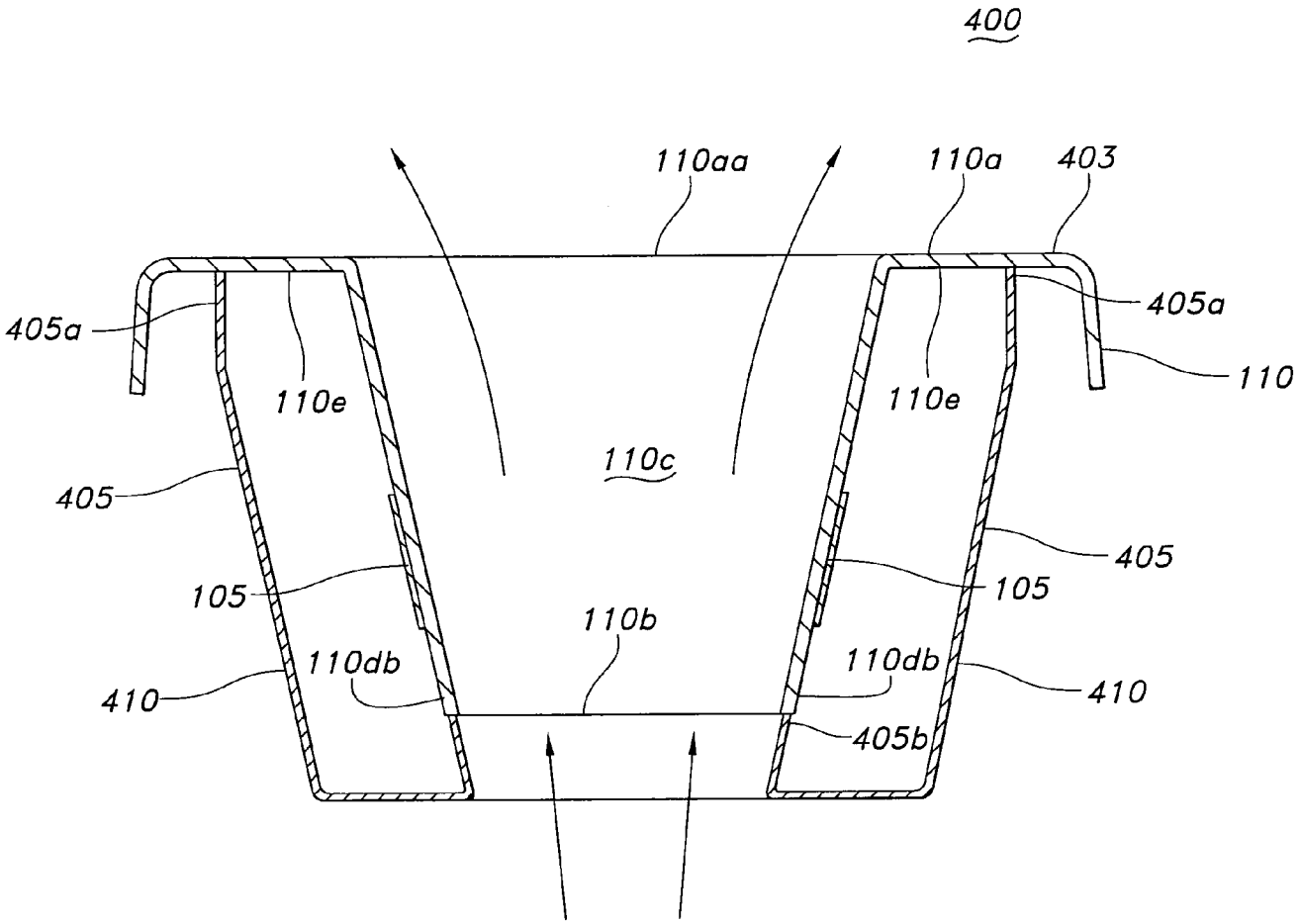
FIG. 4 is a cross-sectional side view of a light fixture with an optical distribution capable of being adjusted, according to another alternative exemplary embodiment.

FIG. 4 is a cross-sectional side view of a light fixture 400 with an optical distribution capable of being adjusted, according to another alternative exemplary embodiment. Like the light fixture 300 of FIG. 3, the light fixture 400 is identical to the light fixture 100 of FIGS. 1 and 2 except that the light fixture 400 includes a cover 405. The cover 405 includes an optically transmissive element 410 that provides protection from dirt, dust, moisture, and the like. The cover 405 is disposed at least partially around the facets 111, with a top end 405*a* thereof being attached to a bottom surface 110*e* of the top end 110*a* of the housing 110. For example, the top end 405*a* can be attached to one or more ledges 520 (shown in FIG. 5) extending from the bottom surface 110*e* of the housing 110. Another end 405*b* of the cover 405 is attached to the bottom end 110*db* of the member 110*d*. In certain exemplary embodiments, there is a sealing element (not shown) between the cover 405 and the member 110*d*, at one or more points of attachment. In certain exemplary embodiments, the cover 405 is configured to control light from the LEDs 105 via refraction, diffusion, or the like. For example, the cover 405 can include a refractor, a lens, an optic, or a milky plastic or glass element.

Figure 5:
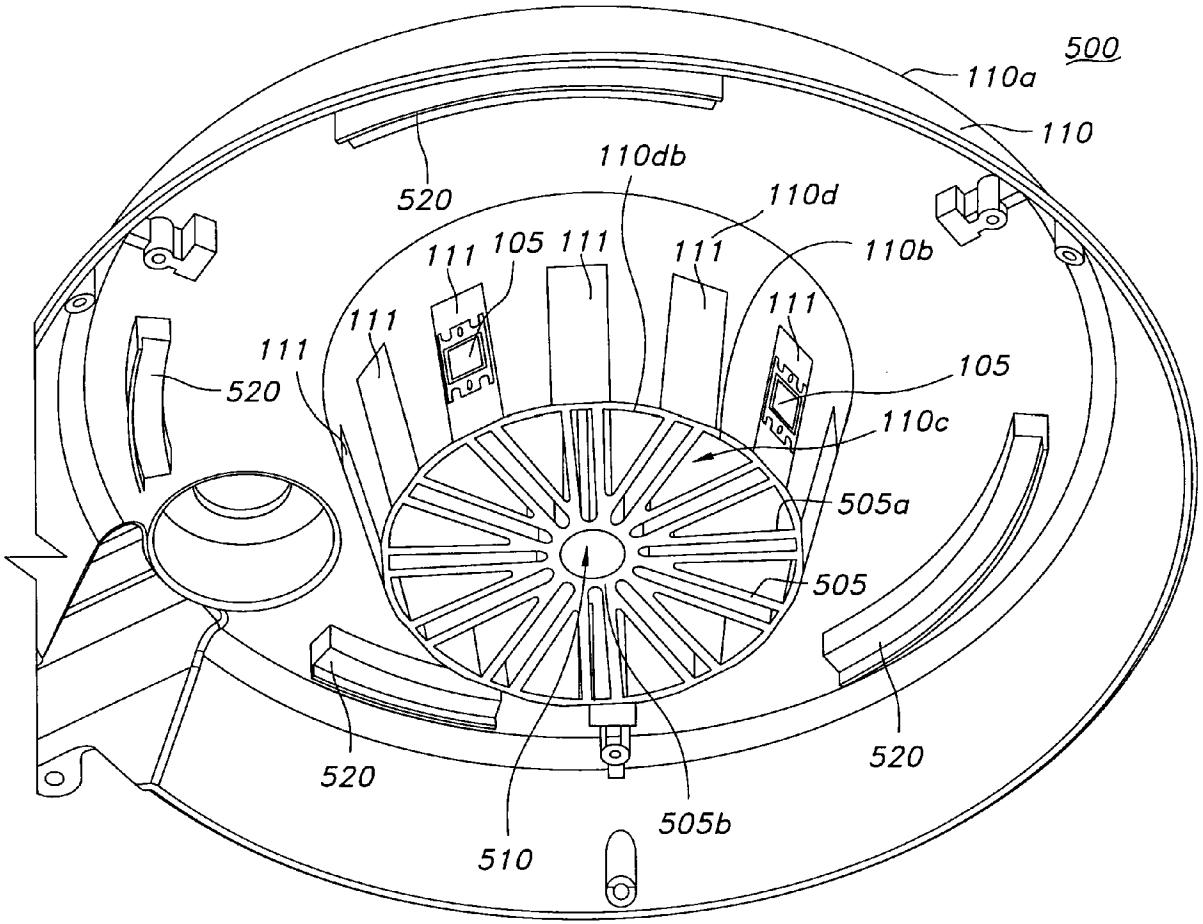
FIG. 5 is a perspective view of a light fixture with an optical distribution capable of being adjusted, according to yet another alternative exemplary embodiment.

FIG. 5 is a perspective view of a light fixture 500 with an optical distribution capable of being adjusted, according to yet another alternative exemplary embodiment. The light fixture 500 is identical to the light fixture 100 of FIGS. 1 and 2 except that the light fixture 500 includes one or more fins 505 acting as heat sinks for managing heat produced by the LEDs 105. In certain exemplary embodiments, each fin 505 is associated with a facet 111 and includes an elongated member 505*a* that extends from an interior surface (of the member 110*d*) opposite its associated facet 111, within the channel 110*c*, to a core region 505*b*. A channel 510 extends through the core region 505*b*, within the channel 110*c*. The fins 505 are spaced annularly around the channel 510. Alternatively, one or more of the fins 505 can be independent of the facets 111 and can be positioned radially in a symmetrical or non-symmetrical pattern.

Heat transfers from the LEDs 105 via a heat-transfer path extending from the LEDs 105, through the member 110*d*, and to the fins 505. For example, the heat 105 from a particular LED 105 transfers from the substrate 105*a* of the LED 105 to its corresponding facet 111, and from the facet 111 through the member 110*d* to the corresponding fin 505. The fins 505 receive the conducted heat and transfer the conducted heat to the surrounding environment (typically air) via convection.

The channel 510 supports convection-based cooling. For example, as described above in connection with FIGS. 1 and 2, the frusto-conical shape of the member 110*d* creates a venturi effect, drawing air through the channel 510. The air travels from the bottom end 110*b* of the housing 110, through the channel 510, and out the top end 110*a*. This air movement assists in dissipating heat generated by the LEDs 105 away from the LEDs 105. In certain alternative exemplary embodiments, the fins 505 converge within the channel 110*c* so that there is not an inner channel 510 within the channel 110*c*. In such an embodiment, the channel 110*c* supports convection-based cooling substantially as described above.

In the embodiment depicted in FIG. 5, the fins 505 are integral to the member 110*d*. In certain exemplary embodiments, the fins 505 can be formed on the member 110*d* via molding, casting, extrusion, or die-based material processing. For example, the member 110*d* and fins 505 can be comprised of die-cast aluminum. Alternatively, the fins 505 can be mounted or attached to the member 110*d* by solder, braze, welds, glue, plug-and-socket connections, epoxy, rivets, clamps, fasteners, or other fastening means known to a person of ordinary skill in the art having the benefit of the present disclosure. Like the light fixtures 300 and 400 of FIGS. 3 and 4, respectively, in certain alternative exemplary embodiments, the light fixture 500 can be modified to include a cover (not shown).

Although illustrated in FIG. 5 as having a frusto-conical geometry, a person of ordinary skill in the art having the benefit of the present disclosure will recognize that the member 110*d* can have any shape, whether polar or non-polar, symmetrical or asymmetrical. For example, the member 110*d* can have a cylindrical shape.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A light fixture, comprising:

a first member comprising:

a top end;

a bottom end; and an exterior surface extending from the top end to the bottom end, wherein the first member comprises a first aperture adjacent the top end, a second aperture adjacent the bottom end, and a channel extending from the first aperture to the second aperture and defined by an interior surface of the first member, the interior surface facing an opposite direction than the exterior surface;

a plurality of light emitting diodes (LEDs) disposed on the exterior surface of the first member, wherein at least one LED is disposed on a first portion of the exterior surface and at least another LED is disposed on a second portion of the exterior surface different than the first portion;

a second member comprising an adjacent end, a distal end, and a side surface extending from the adjacent end to the distal end, at least a portion of the second member being disposed above the LEDs, the second member being coupled to the first member; and a mounting member coupled to the second member, at least a portion of the mounting member extending in a direction substantially orthogonal to a longitudinal axis of the first member.

2. The light fixture of claim 1, wherein one or more LEDs are disposed on a plurality of portions of the exterior surface, each of the plurality of portions of the exterior surface being equidistant from an adjacent portion of the exterior surface.

3. The light fixture of claim 1, wherein the exterior surface of the first member comprises at least one facet, the LEDs being disposed on the facet.

4. The light fixture of claim 1, wherein the perimeter of the top end is larger than the perimeter of the bottom end.

5. The light fixture of claim 1, wherein the plurality of LEDs are asymmetrically disposed about the first member and configured to emit an asymmetric light output.

6. The light fixture of claim 1, further comprising an optically transmissive cover disposed at least partially around the first member.

7. The light fixture of claim 1, further comprising:

a driver electrically coupled to at least one of the plurality of LEDs to control the at least one of the plurality of LEDs; and a photocell electrically coupled to the driver.

8. The light fixture of claim 1, further comprising a plurality of receiving surfaces on the exterior surface, each receiving surface configured to receive at least one LED and wherein the plurality of receiving surfaces provide a plurality of different configuration for a positioning of the plurality of LEDs, each of the plurality of different configuration corresponding to a different optical distribution of the light fixture.

9. A light fixture, comprising:

a first member comprising:

a top end;

a bottom end; and an exterior surface extending from the top end to the bottom end, wherein the first member comprises a first aperture adjacent the top end, a second aperture adjacent the bottom end, and a channel extending from the first aperture to the second aperture and defined by an interior surface of the first member, the interior surface facing an opposite direction than the exterior surface;

a plurality of light emitting diodes (LEDs) disposed on the exterior surface of the first member, wherein at least one LED is disposed on a first portion of the exterior surface and at least another LED is disposed on a second portion of the exterior surface different than the first portion;

a second member comprising an adjacent end, a distal end, and a side surface extending from the adjacent end to the distal end, at least a portion of the second member being disposed above the LEDs, the second member being coupled to the first member;

a mounting member coupled to the second member, at least a portion of the mounting member extending in a direction substantially orthogonal to a longitudinal axis of the first member; and a lens coupled to the second member and disposed at least partially around the first member.

10. The light fixture of claim 9, wherein one or more LEDs are disposed on a plurality of portions of the exterior surface, each of the plurality of portions of the exterior surface being equidistant from an adjacent portion of the exterior surface.

11. The light fixture of claim 9, wherein the first aperture has a first diameter and the second aperture has a second diameter and wherein the first and second diameters are different.

12. The light fixture of claim 9, wherein the top end has a first perimeter and the bottom end has a second perimeter and wherein the first and second perimeters are different.

13. The light fixture of claim 9, wherein the plurality of LEDs are asymmetrically disposed about the first member and configured to emit an asymmetric light output.

14. The light fixture of claim 9, further comprising:

a driver electrically coupled to at least one of the plurality of LEDs to control the at least one of the plurality of LEDs; and a photocell electrically coupled to the driver.

15. A light fixture, comprising:

a member comprising:

an interior surface;

a first aperture;

a second distal aperture, and a channel within the member extending from the first aperture to at least the second aperture and defined by the interior surface of the member;

at least one first light emitting diode (LED) coupled adjacent a first side of the channel; and at least one second LED coupled adjacent a second side of the channel, wherein air enters the channel and transfers at least a portion of the heat generated by the first and second LEDs through the first aperture.

16. The light fixture of claim 15, wherein the second side of the channel is opposite the first side of the channel.

17. The light fixture of claim 15, wherein the channel is configured to transfer at least the portion of the heat generated by the first and second LEDs by venturi effect.

18. The light fixture of claim 15, wherein the first and second LEDs are in thermal communication with the member and configured to transfer heat to the member by convection.

* * * * *